US005525094A

United States Patent [19]

Pallmann

[11] Patent Number: 5,525,094

[45] Date of Patent: Jun. 11, 1996

[54] METHOD AND DEVICE FOR RESHARPENING KNIVES USED IN CUTTING MACHINES

[75] Inventor: Wilhelm Pallmann, Zweibrucken, Germany

[73] Assignee: Pallmann Maschinenfabrik GmbH & Co. KG, Zweibrucken, Germany

[21] Appl. No.: 241,161

[22] Filed: May 10, 1994

[30] Foreign Application Priority Data

May 18, 1993 [DE] Germany ..... 43 16 514.1

[51] Int. Cl.[6] ..... B24B 1/00

[52] U.S. Cl. ..... 451/45; 451/401; 451/149; 451/403; 451/5

[58] Field of Search ..... 451/119, 121, 451/122, 124, 128, 140, 372, 367, 375, 397, 401, 403, 149, 5, 8, 10, 11, 12, 45, 54, 58, 57, 177; 76/31, 37

[56] References Cited

U.S. PATENT DOCUMENTS

| | | | |
|---|---|---|---|
| 1,926,214 | 9/1933 | Raule | 451/149 |
| 2,592,240 | 4/1952 | Bruce | 451/403 |
| 4,557,074 | 12/1985 | Elsner et al. | 451/128 |
| 4,718,198 | 1/1988 | Komossa et al. | 451/122 |
| 4,732,064 | 3/1988 | Pearl | 451/58 |
| 5,094,037 | 3/1992 | Hakomori et al. | 451/58 |
| 5,191,737 | 3/1993 | Snoddy | 451/367 |
| 5,377,454 | 1/1995 | Pedersen et al. | 451/12 |

FOREIGN PATENT DOCUMENTS 4114840 11/1992 Germany .

*Primary Examiner* Bruce M. Kisliuk
*Assistant Examiner* Derris Banks
*Attorney, Agent, or Firm* Wells, St. John, Roberts, Gregory & Matkin

[57] ABSTRACT

A method of resharpening the knives in a chipping machine while they are installed in the knives' rotor is disclosed. For this purpose all knives are moved forward one after another to their functional position by an amount that corresponds to the wear of the edges. As part of this, the radial grinding feed which is required in order to achieve the desired protrusion of the edges above the relevant area of the knives' rotor is pre-programmed based on the detected state of wear. A device to implement this method is also disclosed. The device comprises a rotational disk for the knife rotor placed on top of a machine frame and where an equipment table is provided that supports a cross-wise translatory moveable grinding unit, as well as a radially moveable adjustment device which has a sensor to determine the state of wear of the relevant area of the knife rotor 8 and a stop face to limit the knife feed.

32 Claims, 4 Drawing Sheets

FIG. II

METHOD AND DEVICE FOR RESHARPENING KNIVES USED IN CUTTING MACHINES

BACKGROUND OF THE INVENTION

This invention relates to a method and device for resharpening knives for use in a machine, such as a wood cutting machine, wherein the knives are installed in a cylindrical knife mounting support.

The knives which are mounted inside the cylindrical supports of wood cutting machines are subject to rapid wear, and therefore, they frequently need to be removed and replaced by resharpened knives. Examples of this type of cutting machines are chipping machines that cut wood into chips for further industrial uses. The cutting knives which are mounted onto rims last normally only a few hours, and therefore must be exchanged several times during a work shift, which amounts to about a thousand knife changes a year.

After installing the resharpened knives in the knife rim, their cutting edges must, depending on the intended thickness of the chips, always show the same protrusion opposite the so-called wear down shoes that make up the cylindrical inner wall of the knife rim. As part of this, the knives must be mounted in such a manner that the resharpened knife edges can be adjusted outside the chipping machine by means of a special adjustment device. For this purpose each knife was until now attached in a removable manner to a support plate with a reference surface that determines the protrusion of the cutting edge and which, in turn, contacts a corresponding reference surface provided on the knife supports of the knife rim during the installation of the knife kit, consisting of knives and the knife holding plate. While it is true that this allows a reproducible protrusion of the cutting edge against the original state of the cylindrical inner wall of the knife rim, what is not being considered however, is the respective local wear condition of the inner wall. Over a longer period of time the failure to account for such local wear conditions when adjusting the position of the knives results in aconstant, and in the end no longer acceptable, increase in thickness of the chips produced.

With frequent changes of knives, the handling of the heavy knife kit is not only cumbersome, tiresome, and potentially injurious, but also time consuming; this is true especially since the knives must first be removed from their holding plates before resharpening and then remounted again. At the time of remounting, the knives' cutting edges must also be adjusted to the theoretical protrusion with regard to the before-mentioned opposite reference surface provided on the holding plate.

To avoid these disadvantages, a method and a device have been previously proposed in published German application DE 41 14 840 $A_1$ (laid-open Nov. 22, 1992), wherein the exchange of knives in a fully and automatic manner while simultaneously adjusting the knives' edges by considering the wear condition of the wear down shoes is disclosed. With this method the cumbersome handling of the knife kit during removal and reinstallation of the knives is eliminated; however, the removed knives still have to be resharpened, individually or in groups, with special sharpening machines.

It is the underlying task of the invention to also do away with this costly step of the process without having to forego achieving a precise protrusion of the edges, matched to the respective wear condition of the wear down shoes.

SUMMARY OF THE INVENTION

Accordingly, it is an object of this invention to at least partially overcome the disadvantages of the prior art. Also, it is an object of this invention to provide an improved method and device for resharpening the knives of a wood cutting machine.

Accordingly, in one of its aspects, the invention resides in providing an operational method to resharpen the knives of wood cutting machines, in particular those of chipping machines, where the knives are arranged and fastened in cylindrical mounting supports with releasable clamps, in such a manner that during the operational process their edges form a common circle, characterized in such a manner that the sharpening of the knives occurs by way of grinding in their installed state while the knife mounting support slowly rotates; before sharpening all the knives are loosened one after another in the mounting support, after which they are advanced towards their area of function by an amount relative to the wear of the edges; then, the newly positioned knives are again tightly clamped onto their support; in order to achieve the targeted protrusion of the edges above the relevant area of the knife mounting support the radial feed needed to support the grinding operation is pre-programmed by considering the state of wear of this area.

As a result of these procedural measures according to the invention, completely service-free resharpening of the knives' edges is made possible, while at the same time the knives automatically regain their original protrusion above the inner wall of the knife rim.

While the practice to grind out the wear down shoes of the knife rims in their installed state is known; at the same time, no stimulus for an invention to resharpen the knives' edges was able to arise for the following reason: the theoretically founded and Coy means of tests) confirmed opinions existed among experts that the so-called clearance angle, which comprises the knife face and the cutting face, cannot be smaller than 6°. Since, however, resharpening in an installed state necessarily results in a clearance of 0°, experts heretofore could never seriously consider the possibility of resharpening knife blades in the installed state.

In a further aspect, the present invention resides in an apparatus or device for use in resharpening wood cutting machine knives fastened by releasable clamps in a rotatable cylindrical mounting support by the steps of: loosening the clamps one after another in the mounting support so the knives may be moved therein, moving the knives to a functional position by an amount relative to the wear of the knife edges, tightening the clamps to secure the knives in the mounting support, and grinding the knife edges while rotating the mounting support, the apparatus comprising a machine frame, rotational means, grinding means and adjustment means, said rotational means carried by the machine frame and for engaging and rotating the mounting support, said adjustment means for moving the knives to the functional position commensurate with the wear of the knife edges, said grinding means carried by the machine frame and for grinding the knife edges, said grinding means adapted for translatory movement along the knife edge which is to be ground.

BRIEF DESCRIPTION OF THE DRAWINGS

Further objects and advantages of the invention will appear from the following description taken together with the accompanying drawings in which.

DETAILED DESCRIPTION OF PREFERRED EMBODIMENTS OF THE INVENTION

Figure 1:
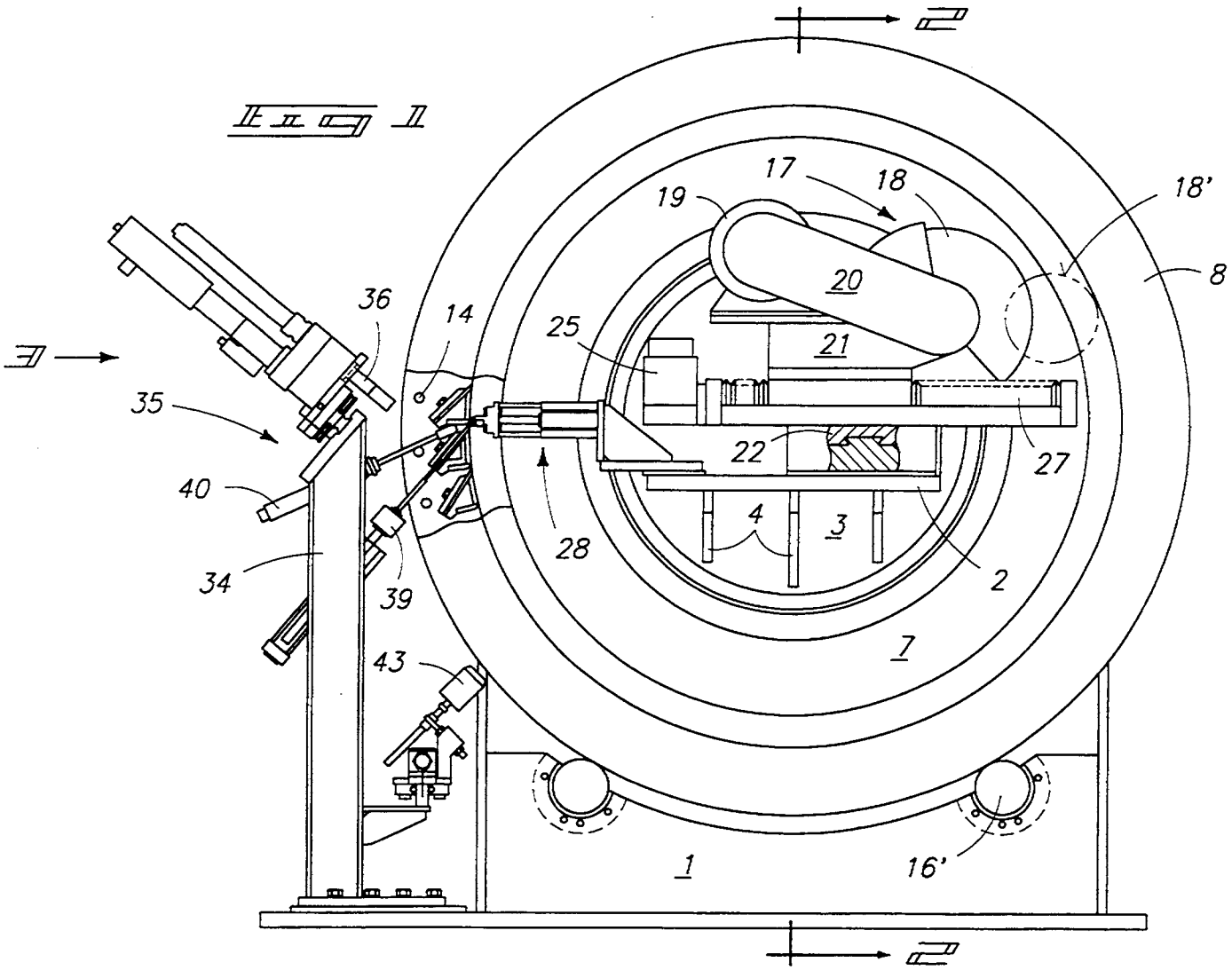
FIG. 1 is a front view of a resharpening device in accordance with a preferred embodiment of the present invention.

According to the invention the resharpening device consists of a machine frame 1, onto which a horizontal equipment table 2 is attached. It is rigidly connected to a circular vertical support plate 3, while the portion of the equipment table that reaches above the support plate 3 is supplied with support brackets 4. Above the equipment table 2, the support plate 3 shows a sizable opening 5.

On the support plate 3 there pivots a turntable 6, which is connected with an axis vertical rotational disk 7 for the concentric attachment of a knife rim 8. The turntable 6 is put in rotation by a pinion 9 whose driving motor 10 is located on an upper platform 11 of the machine frame 1. In order to prevent accidents, the machine frame 1 is surrounded by a protective housing 12, which is depicted only in FIG. 2, in order to give a clear overview of the parts essential to the invention. To the protective housing 12 a pneumatically activated stop unit 13 is attached, whose stop bolts 13' will drop, while the knife rim 8 keeps turning gradually, one after another into positional boreholes 14 which are assigned in one of its two ring disks 8' to the individual knives' mounting supports 15.

In the lower area of the machine frame 1, a pneumatically activated sliding carriage 16 is provided for installation and take-out, consisting of two parallel support rods 16', with which the knife rims 8 are pushed in or out of the resharpening device.

The equipment table 2 holds a grinding unit 17, which consists of a grinding disk 18, a motor 19 and a belt drive 20. The grinding unit 17 is attached to a support 21, which is moveable in axial and radial direction by means of a cross-slide carriage 22, 23. During the sharpening process the axial back and forth movement occurs on a sub-carriage 22 which is driven by a hydraulic unit 24 controlled by limit switches. For the purpose of targeted radial movement of the grinding unit 17, which is arranged on an upper carriage 23 to provide for precise work positioning, a position-guided specialized drive 25 is being used. To protect the slide tracks of the lower and upper carriages 22, 23 bellow sleeves 26, 27 are provided. The circle 18', drawn by dash dots in FIG. 1, symbolizes the diameter of a completely worn grinding disk 18. On the equipment table 2 there is also an adjustment device 28 which consists of a pneumatically activated knife stop face 29, towards which a position sensor 30 is rigidly assigned whose purpose is to gauge the state of wear of the inner wall 8" of the knife rim 8. By adding thin plates 31 at the knife stop face 29, the constant feed of the chipping knives 32 can be adjusted to the respective wear of the edges. The program-controlled radial movement of the knife stop face is handled by a pneumatic unit 33.

A tool combination 35, which is mounted on a tool rack 34, is used to advance the individual knives 32 up to the knife stop 29, as determined by the position sensor 30. The tool combination consists of a spindle 36 for loosening and tightening the clamping screws 37 at the knife mounting supports 15; furthermore of a knives' tamping tool 39, used to individually advance the chipping knives 32, and lastly of a hold down device 40 which takes care of holding down the loosened knife holder plates 38 while the knives are advanced. All tools 36, 39 and 40 are pneumatically activated via program control. Also, the spindle 36 is moveable on a sliding track 41 in the direction of the axle for which a pneumatic unit 42 is provided. Additionally, in the lower part of the tool rack 34 a compressed air nozzle 43 is located also on a sliding track 44 and moveable back and forth in the direction of the axle via a pneumatic unit 45 which is controlled by limit switches.

Figure 2:
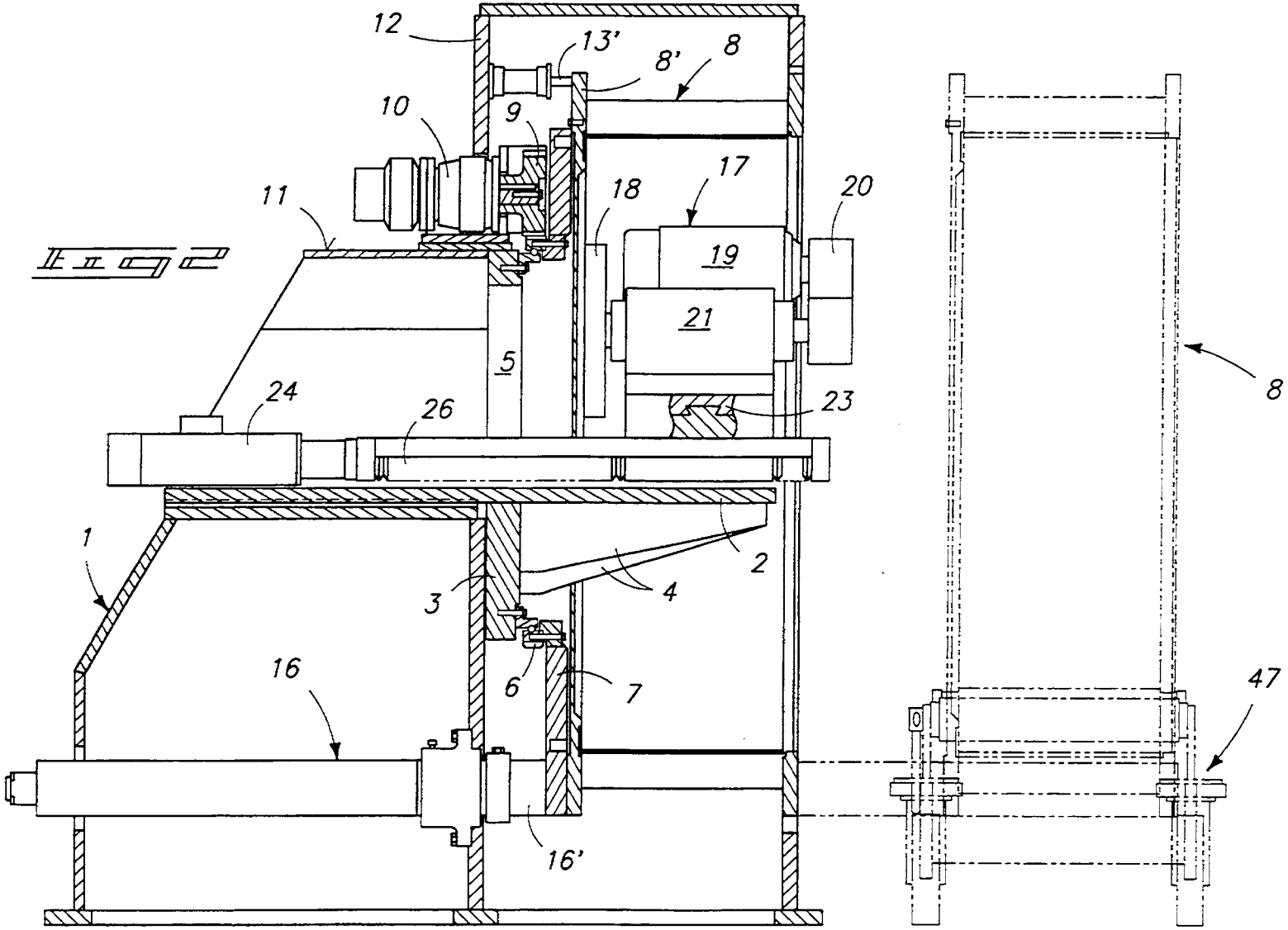
FIG. 2 is a sectional view of the resharpening device of FIG. 1 taken along line II—II.
Figure 3:
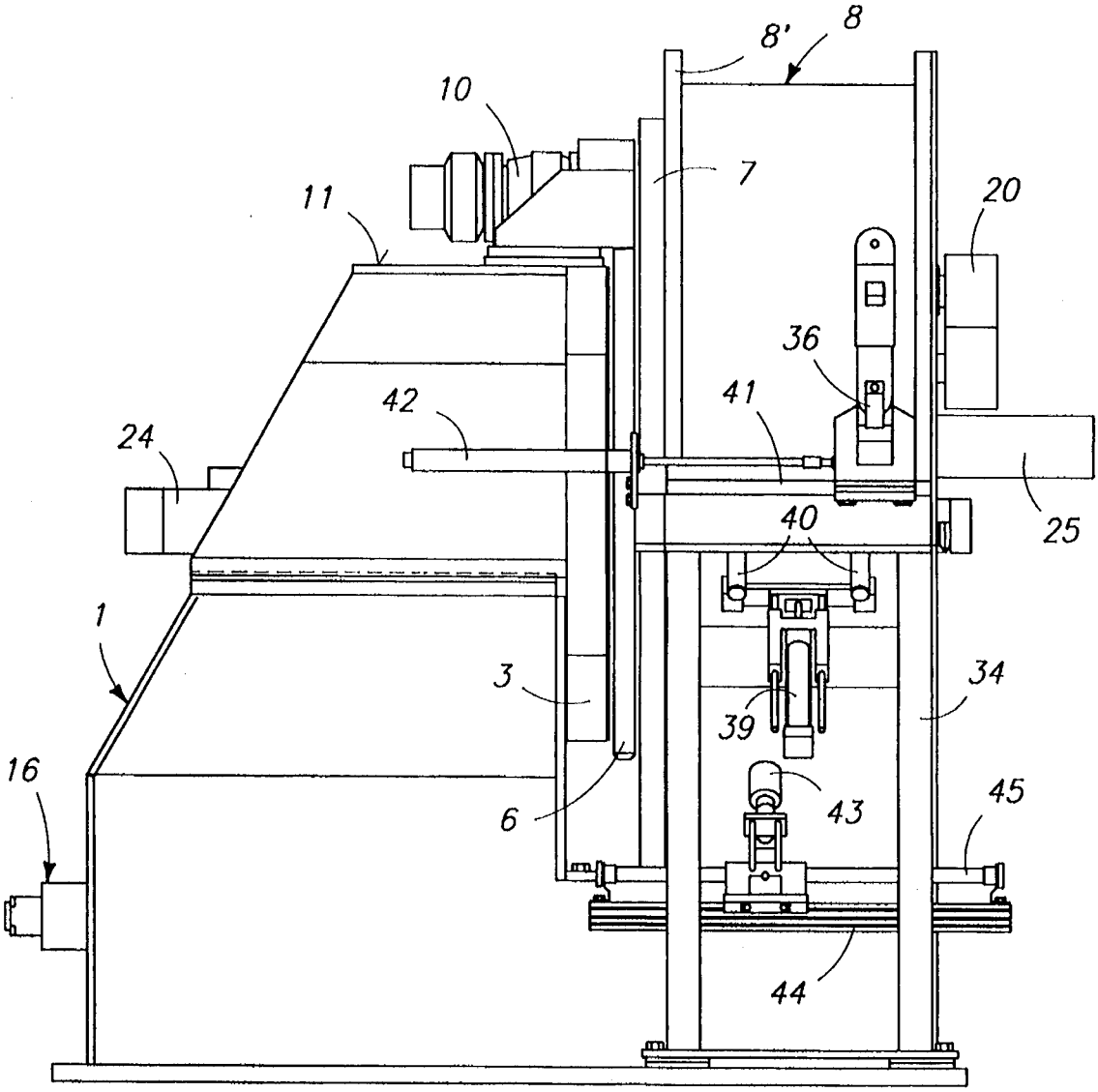
FIG. 3 is a side view of the resharpening device of FIG. 1 in the direction of the arrow III.
Figure 4:
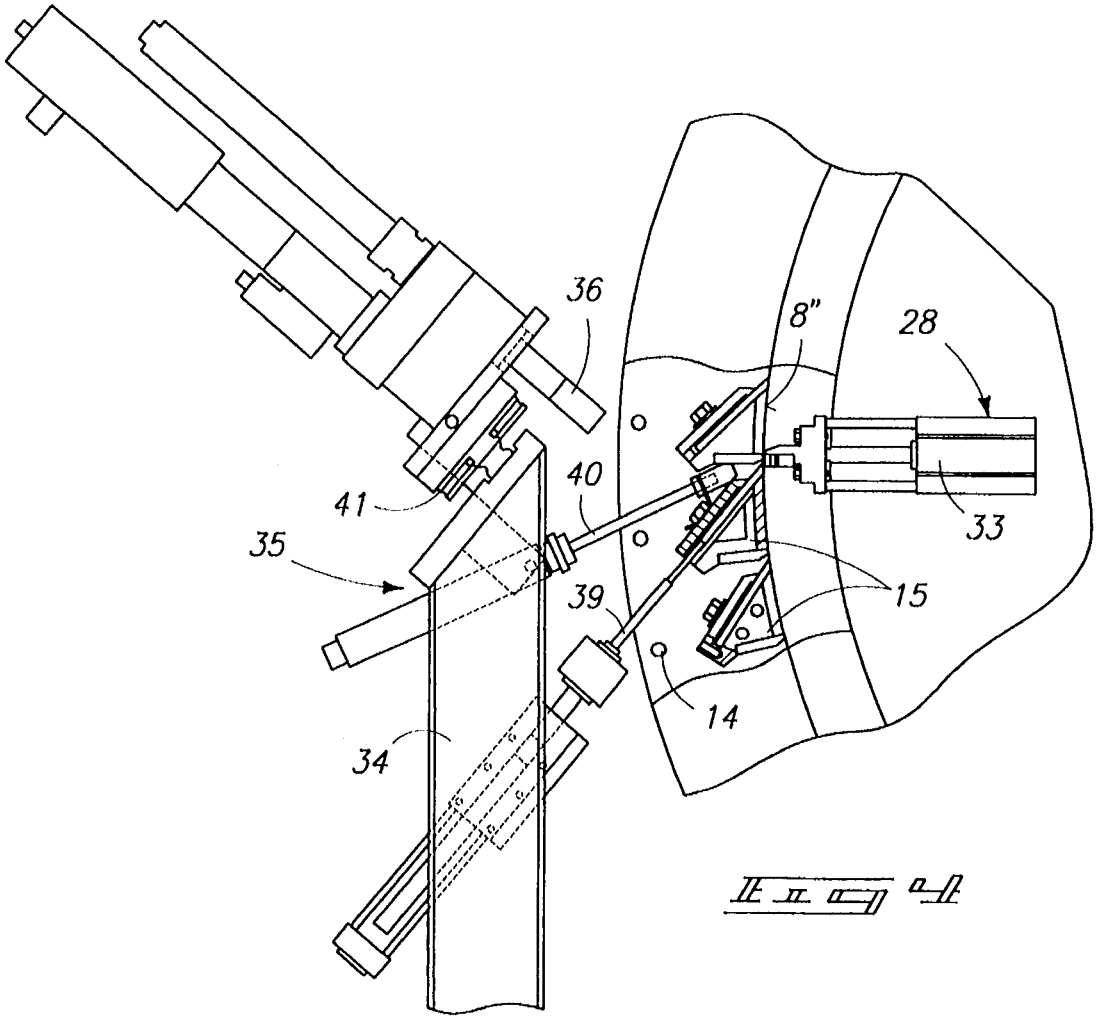
FIG. 4 is a schematic illustration of a tool combination and adjustment device for positioning knives in accordance with the present invention.
Figure 5:
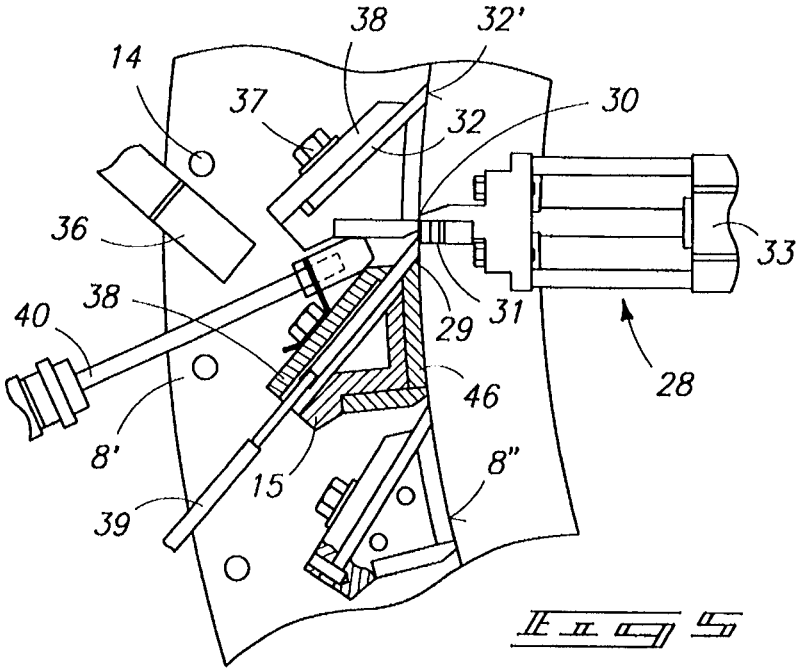
FIG. 5 shows an enlarged view of the tool combination and adjustment device of FIG. 4.

According to the invention the described resharpening device functions as follows:

After a knife rim 8 is removed from a chipping machine, it is transported on a special cart 47 into the sharpening room, where it will be put in position in front of the resharpening device, as can be seen in FIG. 2. Then the sliding carriage 16 used for installation and take-out is moved out so far that its support rods 16' reach under the knife rim 8 and pull it on its reverse movement onto the centering position provided on the rotational disk 7. Here it is fastened with the stop bolt 13' already having dropped into one of the positional boreholes 14. Now the centrally controlled function of the sharpening process begins:

At first the spindle 36 is activated in such a way that it loosens the clamping screws 37 of the knives' mounting support 15 one after another. At the same time the knife stop face 29 is radially advanced far enough by its pneumatic unit 33, that its assigned position sensor 30 touches a spot of the wear down shoe 46 in the vicinity of the corresponding knife 32. Now the hold down device 40 and the tamping tool 39 are activated, pushing inward the respective knife 32 of the knife rim 8 until its face 32' touches the knife stop face 29. This positioning of the knife is then fixed by successive tightening of the clamping screws 37 by means of the spindle 36. Next the central control causes the pulling back of the knife stop face 29 and of the stop bolt 13' as well as the continuing rotation of the knife rim 8 by one knife spacing, after which the stop bolt 13' drops into the next positional bore hole 14. Now the next knife 32 is advanced in the manner just described; this process is repeated until all knives 32 of a knife rim have been uniformly advanced and fixed in their new position.

The central control system now directs the pinion motor 10 to constantly rotate the knife rim 8 at low speed. It also causes the grinding support 21 to be radially advanced toward the knife rim 8 until the grinding disk 18 touches the advanced knives 32. At the same time the torque of grinding disk 18 increases which causes the power consumption of the drive motor 19 to increase, which in turn signals to the central processing system, in the form of a control impulse, the beginning of the actual feed for grinding; it is at this point during the grinding process at which the program-controlled special drive 25 gradually moves the grinding unit 17 against the faces 32' of the knives 32. This feed for grinding which amounts to only a few tenth of millimetres is pre-programmed with two parameters as follows: on the one hand, the state of wear of the inner wall 8" of the knife rim 8 and its wear down shoes 46 as determined and averaged by the position sensor 30, and on the other hand, the input of the targeted protrusion of the knives' edges 32 above this inner wall 8". Since the grinding disk 17 is gradually wearing down, the actual respective diameter of the grinding disk 17 is determined after each sharpening process by means of a trueing device (not shown), which is then entered into the program controlling the feed as a correction factor.

At the end of this grinding feed operation, programmed in this manner by the electronic central control all knives 32 will have been sharpened in accordance with the desired protrusion of the edges. Program control now shuts down all rotational drives and returns all equipment to their original positions. Now the knife rim 8 can be detached from the rotational disk 7 and can then be placed onto the special cart 47, by means of the sliding carriage 16 used for installation and take-out, where it can be kept in readiness for a knife rim exchange of a chipping machine.

In contrast to the method of operation described above there may be situations where the feed of the knives can take place after the resharpening of their edges such as when there is still a sufficiently large protrusion available for grinding off after the wear cycle. This is, for example, the case with chipping machines, that are set up for the production of relatively thick chips. In such cases while, on the one hand, the feed required for resharpening must be entered into the control program as an empirical value, there is, on the other hand, the advantage that the adjustment device 28 can align the protrusion of the already resharpened edges individually and more precisely with the local wear of the inner wall 8" of the knife rim 8.

It will be understood that, although various features of the invention have been described with respect to one another of the embodiments of the invention, the various features and embodiments may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A method to resharpen edges of knives of wood cutting machines in which the knives are arranged and fastened in a cylindrical mounting support with releasable clamps, in such a manner that during the operational process the knife edges form a common circle, characterized by sharpening the knives by way of grinding the edges of the knives while the knives are in an installed state fastened in the mounting support while rotating the knife mounting support; before sharpening all the knives are loosened one after another in the mounting support, after which they are advanced towards a functional position by an amount relative to the wear of the knife edges; then, the newly positioned knives are again tightly clamped onto the mounting support; in order to achieve a desired protrusion of the edges relative to the mounting support the extent of grinding is preprogrammed by considering the state of wear of each relevant area.

2. A method in accordance with claim 1, characterized in such a manner that the state of wear of the knives in each relevant area is sensed while the knives are individually advanced and an average value is established.

3. A method in accordance with claim 1, characterized in that before and after sharpening the knives and the mounting support are cleaned by applying a medium under pressure.

4. A method in accordance with claim 2, characterized in that before and after sharpening the knives and the mounting support are cleaned by applying a medium under pressure.

5. A method in accordance with claim 1, characterized in that the grinding operation occurs while a cooling agent is applied.

6. A method in accordance with claim 4, characterized in that the grinding operation occurs while a cooling agent is applied.

7. A method in accordance with claim 1, characterized in that for the purpose of resharpening the edges of the knives, the knife mounting support is taken out from the wood cutting machine and is handled in a special sharpening device.

8. A method in accordance with claim 6, characterized in that for the purpose of resharpening the edges of the knives, the knife mounting support is taken out from the wood cutting machine and is handled in a special sharpening device.

9. A device for implementing the method of claim 7 characterized by a machine frame having a rotational disk for engaging the knife rim, a translatory moveable grinding unit, and an adjustment unit for uniformly advancing the knives commensurate with the wear on the edges.

10. A device for implementing the method of claim 8 characterized by a machine frame having a rotational disk for engaging the knife rim, a translatory moveable grinding unit, and an adjustment unit for uniformly advancing the knives commensurate with the wear on the edges.

11. A device in accordance with claim 9, characterized in that the grinding unit includes a rotational grinding disk supported on a sliding cross carriage, the cross carriage being moveable in axial as well as radial direction; the adjustment unit comprising a tamping tool acting on a back side of the knives, and a stop face for limiting the advance of the knives.

12. A device in accordance with claim 10, characterized in that the grinding-unit includes a rotational grinding disk supported on a sliding cross carriage, the cross carriage being moveable in axial as well as radial direction; the adjustment unit comprising a tamping tool acting on a back side of the knives, and a stop face for limiting the advance of the knives.

13. A device in accordance with claim 11, characterized in that a position sensor is assigned to the stop face to capture the state of wear of each relevant area of the knife rim.

14. A device in accordance with claim 12, characterized in that a position sensor is assigned to the stop face to capture the state of wear of each relevant area of the knife rim.

15. A device in accordance with claim 13, characterized in that the position sensor is integrated into an electronic control device which programs the radial feed of the grinding unit needed to achieve the desired protrusion of the knife edges, based on the state of wear of the inner wall of the knife rim.

16. A device in accordance with claim 14, characterized in that the position sensor is integrated into an electronic control device which programs the radial feed of the grinding unit needed to achieve the desired protrusion of the knife edges, based on the state of wear of the inner wall of the knife rim.

17. A device for implementing the method of claim 7, characterized in that the adjustment unit for advancing the knives consists of a tool combination which comprises a spindle for the loosening of the releasable clamps and a hold down device that acts upon a loosened clamp.

18. A device for implementing the method of claim 7, characterized in that the adjustment unit for advancing the knives consists of a tool combination which comprises a spindle for the loosening of the releasable clamps and a hold down device that acts upon a knife holding plate.

19. A device in accordance with claim 17, characterized in that the sequence of the functional operations of the tool combination is controlled by an automatic sequence control device.

20. A device in accordance with claim 18, characterized in that the sequence of the functional operations of the tool combination is controlled by an automatic sequence control device.

21. A method to resharpen edges of knives of a wood cutting machine, in which the knives are fastened by releasable clamps in a rotatable cylindrical mounting support so that during operation the edges of the knives form a common circle, the method comprising moving said knifes to a functional position one after another by:

loosening each clamp in the mounting support so an associated knife may be slidably moved therein, after said each clamp is loosened, slidingly advancing the associated knife to a functional position by an amount relative to the wear of the knife edge, and tightening said clamp to secure knife in the mounting support, after all of said knives are advanced, grinding the knife edges while rotating the mounting support, whereby the extent of grinding is preprogrammed in relation to the state of wear of a relevant area of the mounting support from which the knife edges protrude.

22. An apparatus for use in resharpening edges of knives of wood cutting machines in which the knives are fastened by releasable clamps in a rotatable cylindrical mounting support, the apparatus comprising a machine frame, rotational means for rotating the mounting support, grinding means for resharpening said edges and adjustment means for positioning the knives in a functional position, said rotational means carried by the machine frame and for engaging and rotating the mounting support while the knife edges are ground, said adjustment means including clamp engagement means to loosen and tighten said clamps, and knife positioning means for moving the knives to the functional position said grinding means carried by the machine frame and adapted for translatory movement along the knife edges which are to be ground, with said mounting support engaged by the rotational means, the adjustment means sequentially moving each knife to the functional position by:

the clamp engagement means loosening each clamp so an associated knife may be slidably moved therein, after said each clamp is loosened the knife positioning means moving the associated knife to the functional position by an amount relative to the wear of the knife edge, and with the associated knife moved to the functional position, the clamp engagement means tightening said clamp to secure the advanced knife in the :mounting support, the adjustment means then moving a next knife until all of said knives are advanced, after all of said knives are advanced, the grinding means grinding the knife edges while said mounting support is rotated by the rotational means.

23. An apparatus as claimed in claim 22 wherein each of said clamps includes a threaded coupling member, the clamps loosened or tightened by turning said coupling member, the clamp engagement means comprising a rotatable spindle and a hold down device, the spindle for engaging and rotating the threaded coupling member to loosen said clamp so that the knife may be moved therein, the hold down device acting upon the loosened clamp while said knife positioning means moves said knife to the functional position.

24. An apparatus as claimed in claim 22 wherein the grinding means comprises a grinding disk and a carriage, said grinding disk rotatably mounted on said carriage and moveable thereon in both an axial direction along the knife edges and in a radial direction towards the knife edges.

25. An apparatus as claimed in claim 23 wherein the knife positioning means includes tamping means for moving said knives to the functional position and stop means for positioning the knife edges, the tamping means comprising an elongate member slidable to engage and urge said knives into contact with said stop means.

26. An apparatus as claimed in claim 25 wherein the stop means includes a position sensor for detecting the state of wear of an area of the mounting support from which each of said machine knives protrudes.

27. An apparatus as claimed in claim 26 wherein said position sensor includes electronic control means for controlling movement of the grinding disk in the radial direction in relation to the state of wear of the area of the mounting support from which the knives protrude.

28. An apparatus as claimed in claim 27 further comprising automatic sequence control means, said automatic sequence control means controlling the operation of each of said machine frame, rotational means, adjustment means and grinding means.

29. A method as claimed in claim 21 wherein the wear of the relevant area of the mounting support is sensed while the knives are individually advanced and an average value is established.

30. A method as claimed in claim 29 wherein before and after sharpening the knives and the mounting support are cleaned by applying a medium under pressure.

31. A method as claimed in claim 30 wherein when grinding the knife edges a cooling agent is applied.

32. A method as claimed in claim 21 wherein the grinding of the knife edges is accomplished with the mounting support in a sharpening apparatus separate from the wood cutting machine.

* * * * *